US010050338B1

(12) United States Patent
O'Loughlin

(10) Patent No.: US 10,050,338 B1
(45) Date of Patent: Aug. 14, 2018

(54) VARIABLE FOCUS MICROWAVE ANTENNA

(71) Applicant: The United States of America as represented by the Secretary of the Air Force, Washington, DC (US)

(72) Inventor: James P. O'Loughlin, Placitas, NM (US)

(73) Assignee: THE UNITED STATES OF AMERICA AS REPRESENTED BY THE SECRETARY OF THE AIR FORCE, Washington, DC (US)

( * ) Notice: Subject to any disclaimer, the term of this patent is extended or adjusted under 35 U.S.C. 154(b) by 343 days.

(21) Appl. No.: 15/158,889

(22) Filed: May 19, 2016

Related U.S. Application Data

(60) Provisional application No. 62/169,533, filed on Jun. 1, 2015.

(51) Int. Cl.

| | |
|---|---|
| ***H01Q 19/12*** | (2006.01) |
| ***H01Q 1/36*** | (2006.01) |
| ***H01Q 19/10*** | (2006.01) |
| *H01Q 15/14* | (2006.01) |
| *H01Q 19/06* | (2006.01) |
| *H01Q 1/12* | (2006.01) |

(52) U.S. Cl.
CPC ..... *H01Q 1/36* (2013.01); *H01Q 19/10* (2013.01); *H01Q 1/1292* (2013.01); *H01Q 15/141* (2013.01); *H01Q 19/06* (2013.01); *H01Q 19/062* (2013.01); *H01Q 19/12* (2013.01)

(58) Field of Classification Search
CPC .... H01Q 19/12; H01Q 15/141; H01Q 1/1292; H01Q 19/062; H01Q 19/06
USPC ..... 343/840, 753, 706, 755, 912
See application file for complete search history.

(56) References Cited

U.S. PATENT DOCUMENTS

| | | | | |
|---|---|---|---|---|
| 4,468,675 | A | 8/1984 | Robinson | |
| 8,230,581 | B1 | 7/2012 | Wilcoxon et al. | |
| 2010/0149660 | A1* | 6/2010 | Bowers ..... | G02B 27/40 359/724 |

OTHER PUBLICATIONS

Koch, K.E., "Metal-Lens Antenna", Proceedings of the I.R.E. (34), Nov. 1946, pp. 816-828, vol. 11.
Yu, Ang et al., "Apperture Efficiency Analysis of Rellectarray Antennas", Microwave and Optical Technology Letters, Feb. 2010, vol. 52, No. 2.

(Continued)

*Primary Examiner* — Joseph Lauture
(74) *Attorney, Agent, or Firm* — James M. Skorich

(57) ABSTRACT

Concentric shapes (e.g., discs and rings), are nested and displaced from a central plate. The discs are individually positioned by means of mechanical or electro-mechanical actuators such that the over-all result approximates a spherical surface reflector antenna having an adjustable radius of curvature, with the radii of curvature being equivalent to the focal length of the antenna. Another innovation includes reducing the dimensional positioning of the various discs by a modulo of the wavelength of the operating frequency of the antenna, thus reducing the throw accommodation of the actuators to only one wavelength. Each of the discs and the central plate are designed to have substantially the same area, as a nominal configuration. The accuracy of the approximation is improved as the number of discs is increased; however, very acceptable performance is obtained with as few as ten discs when compared to a perfect spherical surface.

20 Claims, 4 Drawing Sheets

(56) References Cited

OTHER PUBLICATIONS

Lawrance, Julie et al., "Metal Plate Lenses for a High Power Microwave Zoom Antenna", The University of New Mexico, 2014, Pub. No. 3681901.
Lin, Cheng-Hung et al., "Planar Fresnel Zone Lens Antenna", Progress in Electromagnetics Research Symposium, 2009, p. 327.

* cited by examiner $$P(z,\Phi t,rt,F) := \left[\left|\int_0^{2\cdot\pi}\int_0^{\frac{D}{2}} \frac{e^{-i\cdot k\cdot\sqrt{(ra\cdot\cos(\Phi a)-rt\cdot\cos(\Phi t))^2+(ra\cdot\sin(\Phi a)-rt\cdot\sin(\Phi t))^2+\left(F-\sqrt{F^2-(ra\cdot\cos(\Phi a))^2-(ra\cdot\sin(\Phi a))^2}-zt\right)^2}\cdot ra}}{\sqrt{(ra\cdot\cos(\Phi a)-rt\cdot\cos(\Phi t))^2+(ra\cdot\sin(\Phi a)-rt\cdot\sin(\Phi t))^2+\left(F-\sqrt{F^2-(ra\cdot\cos(\Phi a))^2-(ra\cdot\sin(\Phi a))^2}-z_0\right)^2}}\, dra\, d\Phi a\right|\right]^2$$

FIG. 4

$$PNx(N,z,F) := \left[\left|\sum_{n=1}^{N}\int_{\frac{Dr_{n-1}}{2}}^{\frac{Dr_n}{2}}\int_0^{2\cdot\pi} \frac{e^{-i\cdot k\cdot\sqrt{(r\cdot\cos(\Phi))^2+(r\cdot\sin(\Phi))^2+\left[z-\left[F-\sqrt{F^2-\left(\frac{Dr_n}{2}\right)^2}\right]\right]^2}\cdot r}}{\sqrt{(r\cdot\cos(\Phi))^2+(r\cdot\sin(\Phi))^2+\left[z-\left[F-\sqrt{F^2-\left(\frac{Dr_n}{2}\right)^2}\right]\right]^2}}\, d\Phi\, dr\right|\right]^2$$

FIG. 5

VARIABLE FOCUS MICROWAVE ANTENNA

CROSS REFERENCE TO RELATED APPLICATIONS

This application claims the priority benefit of U.S. Provisional Patent Application No. 62/169,553, titled "Variable Focus Microwave Antenna System and Method", and filed on Jun. 2, 2015; the entire contents of this application are incorporated herein by reference.

STATEMENT OF GOVERNMENT INTERST

The conditions under which this invention was made are such as to entitle the Government of the United States under paragraph 1(a) of Executive Order 10096, as represented by the Secretary of the Air Force, to the entire right, title and interest therein, including foreign rights.

FIELD OF THE DISCLOSURE

The purpose of the disclosure is an improved variable focus antenna.

BACKGROUND

A "Metal-Lens Antenna" was proposed by K. E. Koch, *Proceedings of the I.R.E.,* (34) 11, pp. 816-828 (November 1946) but has not been used much since then. A variable focus "Zoom Antenna" was proposed by Julie E. Lawrance of the Air Force Research Lab and Christos Christodoulou of the University of New Mexico using a pair of the "Metal-Lens Antennas" proposed by K. E. Koch. Although this proposed "Zoom Antenna" does provide a variable focus feature, it is mechanically awkward and limited to small diameters for practical applications. Recently, the "Reflectarray" antenna concept has been developed which has a variable focus feature. This antenna is described in "Aperture Efficiency Analysis of Reflectarray Antennas", Ang Yu, et al., *Microwave and Optical Technology Letters*, Vol. 52, No. 2, February 2010. This implementation is essentially a phased array of elements which are the approximate size of the wavelength and which cover the antenna aperture. In the case of large or even moderate size apertures, the number of elements is enormous. For large apertures at small wavelengths, the number of elements can easily reach into the hundreds of thousands or more. Each element must be individually programmed via a computer connection which is obviously a very complex, expensive and undesirable situation

SUMMARY

Aspects of the embodiments disclosed herein include an antenna comprising: a plurality of concentric shapes surrounding a central plate and located in offset planes substantially parallel to the central plate; and wherein each of the concentric shapes have different dimensions along a spherical shaped contour.

Further aspects of the embodiments disclosed herein include a method of variably focusing an antenna comprising: individually adjusting by a plurality of actuators each of a plurality of concentric shapes surrounding a central plate and located in offset planes substantially parallel to the central plate, each of said plurality of concentric shapes having different dimensions determined by a spherical shaped contour.

Additional aspects of the embodiments disclosed herein include an antenna comprising: a plurality of concentric discs having different dimensions surrounding a central plate and located in offset planes substantially parallel to the central plate, wherein the areas of the plurality of discs and the central plate are substantially equal; and focusing of the antenna is adjustable by moving the concentric discs in a plane substantially parallel to an axis central to the concentric discs.

BRIEF DESCRIPTION OF THE DRAWINGS

FIG. 4 shows an equation for calculation of the boresight relative power density of an ideal spherical antenna.

FIG. 5 illustrates an equation to calculate the approximation of the boresight power density.

DETAILED DESCRIPTION

There is a need for large microwave antennas that are capable of efficiently focusing megawatt power levels while tracking a target or being adaptable to a variable range. For large antennas and short wavelengths a considerable part of the range lies within the fresnel field of the antenna and it is therefore necessary for the antenna to have a dynamic focusing ability to deal with spot irregularities.

Figure 1A:
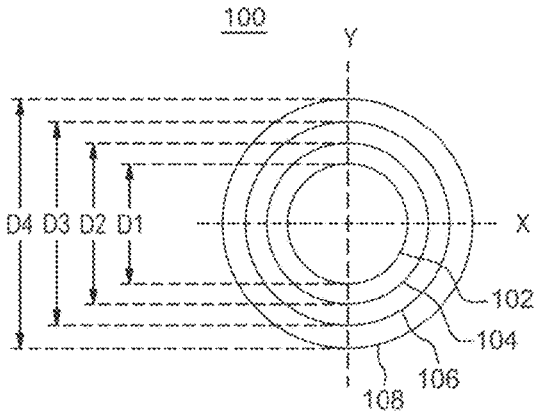
FIG. 1A shows a front view of a spherical antenna assembly 100 formed from a central circular area plate 102 surrounded by N (e.g., in this example three) concentric shapes (e.g., discs or rings) 104, 106, and 108, each lying in a plane substantially parallel to the x-y axis which is perpendicular to the z axis.

FIG. 1A shows a front view of an approximate a spherical antenna assembly 100 formed from a central area plate 102 surrounded by N (e.g., three) concentric shapes 104, 106, and 108 having increasing diameters. Although the embodiments described herein show the shapes being circular discs of equal area, the same basic principles include discs of unequal area, shapes other than discs such as squares, rectangles, ellipses, and any other shapes that are nested in a similar concentric manner as the antenna assembly 100. The term concentric shall be used herein to mean shapes that share the same center with the larger shapes often completely surrounding the smaller shape. Hereinafter, central area plate 102 may be referred to as a central disc and the shapes 104, 106, and 108 as discs but it is too be understood they may also be other shapes. Also, in some embodiments, the discs 102, 104, 106 and 108 may be contiguous.

Figure 1B:
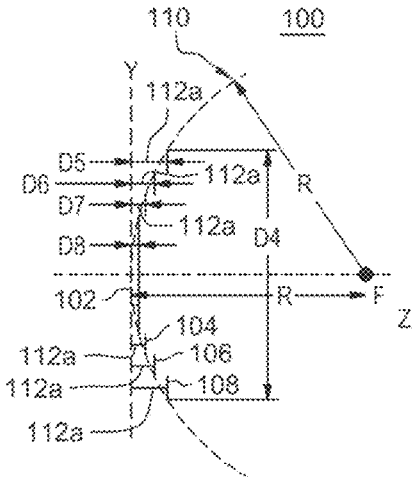
FIG. 1B shows a side view of the antenna assembly 100 of FIG. 1A.
Figure 1C:
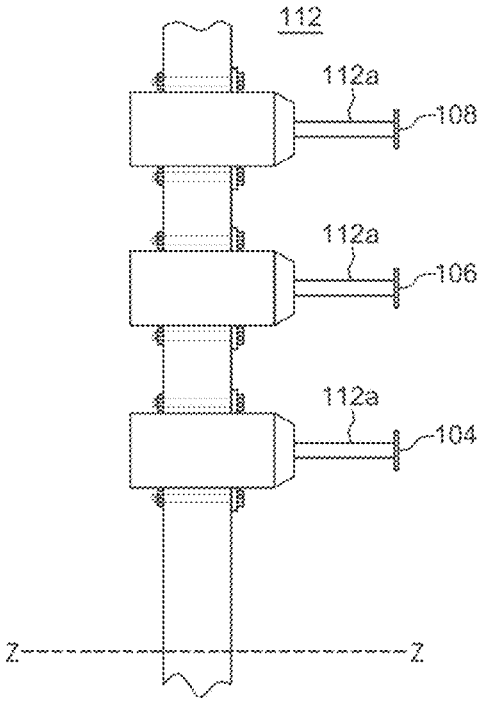
FIG. 1C is a side view of one of exemplary actuators used to manipulate the concentric discs of the antenna assembly 100.

FIG. 1B shows a side view of the antenna assembly 100 of FIG. 1A. The discs 104, 106 and 108 may be individually positioned by means of a mechanical or electro-mechanical actuator(s) 112 such that the over-all result is a suitable approximation of a spherical surface reflector antenna of various radii of curvature (shown as dashed line 110). The actuator 112 is connected to a central computer system to allow for adjustable focusing of the antenna (central computer system not shown). FIG. 1C is a side view of an exemplary actuator 112 with arms 112*a* used to manipulate the discs 104-108 of the antenna assembly 100. Each of the discs 104-108 are acted upon by actuator arms 112*a* that are capable of moving the discs in the z direction as shown in FIG. 1B such that each disc always lies in a plane substantially parallel to the x-y axis and held concentric with the other discs. A reference ideal spherical contour of the antenna 100 is shown (i.e., dashed line 110) with a radius, R, with F being the focal point. The radii of curvature are equivalent to the focal length of the antenna. The number of discs 104-108 plus the central disc 102 totaling four is not a limitation but rather this small number of discs is used for exemplary purposes. For example, the number of discs N may be ten discs which may be used to better approximate a spherical antenna.

The antenna assembly 100 may receive as well as transmit signals. In reception mode, the antenna is able to provide advantageous receive characteristics by concentrating the receive gain/selectivity at a specific range location to which it is focused.

As shown in FIG. 1A, the outermost disc 108 has a diameter D4; disc 106 has a diameter D3; disc 104 has diameter D2; and the center area 102 has a diameter D1. The diameters D1 to D4 are chosen such that the areas of each of the discs 104-108 and the central area 102 are substantially equal as a nominal configuration; however, the areas may be otherwise proportioned based on detailed functional considerations. The equal area choice corresponds to each disc 104, 106, and 108 and central area 102 having the same power if the entire antenna assembly 100 is uniformly illuminated. As illustrated by FIG. 1B, the varying off-set dimensions D5, D6, D7 and D8 of each disc from the x-y reference plane are determined such that the outer diameter of the disc aligns with the reference ideal spherical antenna radius 110 (and correspondingly below the Z-axis as well). If an increasingly large number of discs are used the antenna assembly 100 approaches the ideal spherical shape. However, for practical purposes using a small number of discs will provide a satisfactory approximation. The accuracy of the approximation is improved as the number of discs is increased; however, very acceptable performance is obtained with as few as 10 discs when compared to a perfect spherical surface. It is not feasible and questionably even possible to physically distort the radius of curvature of a conventional spherical disc antenna to obtain variable focus performance; therefore the antenna assembly 100 overcomes this limitation for most any practical application (e.g., microwave applications) wherein a variable focus is required to obtain a particular system performance.

Figure 2:
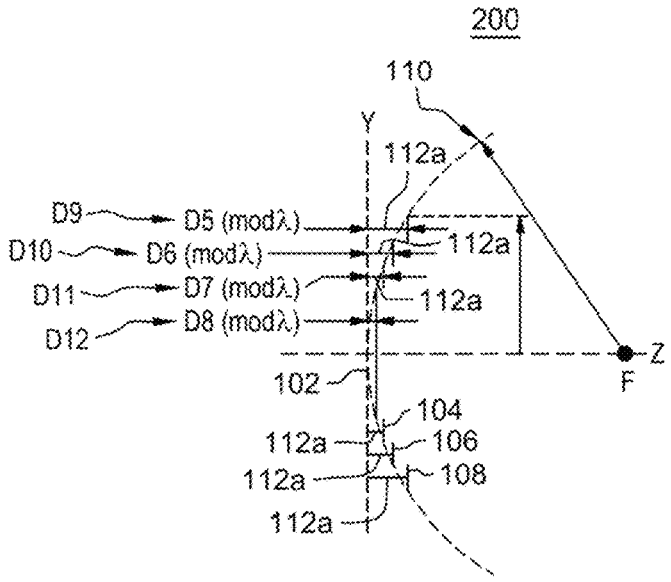
FIG. 2 shows an alternative embodiment of the antenna assembly 100 of FIGS. 1A and 1B.

In an alternative embodiment, antenna assembly 200 of FIG. 2 includes the reducing the dimensional positioning of the various discs by a modulo of the wavelength thus reducing the throw accommodation of the actuators 112 to only one wavelength (k). Therefore the configuration of the antenna assembly 100 can be further simplified by recognizing the fact that the radiated field from the antenna assembly 100 is determined by summing all of the differential contributions from each disc 104-108 and the central plate 102. This summation depends primarily on the phase difference between the differential elements and is insensitive to integral differences in wavelengths. Therefore, any integral wavelengths in the offset dimensions D5, D6, D7 and D8 can be reduced to only the remainder fractional wavelength. That is, the calculated values can be reduced by taking the value modulo of the wavelength, λ. The revised and improved offset values are shown in antenna assembly embodiment 200 of FIG. 2 as D9, D10, D11, and D12; respectively, D5(mod λ), D6(mod λ)), D7(mod λ), and D8(mod λ).

Figure 3:
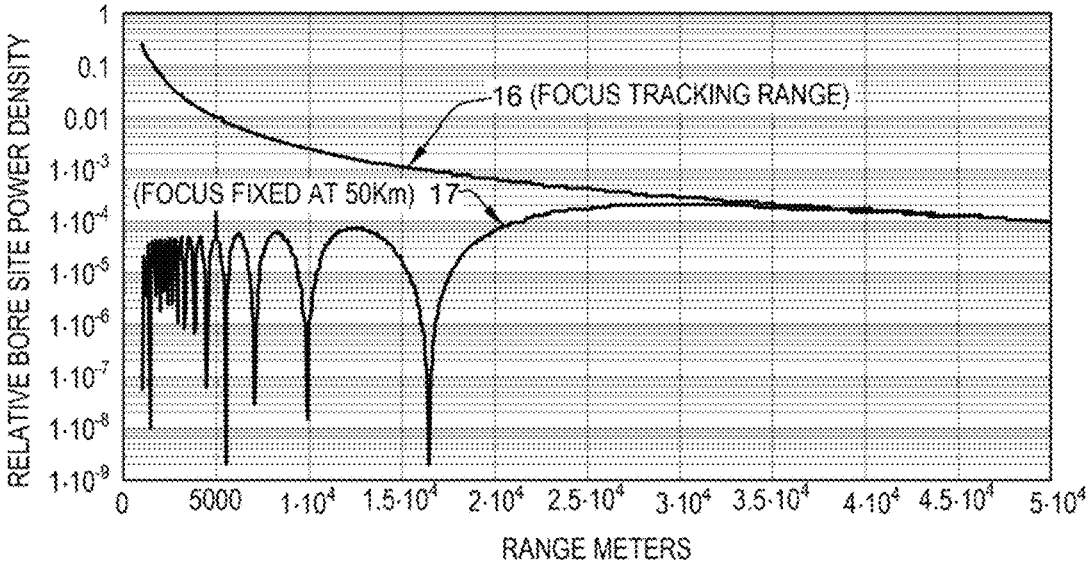
FIG. 3 illustrates a plot of the power density on a boresight of the antenna assembly 100 compared to an ideal focus tracking range antenna with the same characteristics except the focus is programmed to continuously track the range.

Advantages of the embodiments disclosed herein may include that the power density on the antenna boresight (i.e., the optical axis of maximum radiated power of a directional antenna) of the antenna assembly 100 (and 200) is an indicator of the focusing characteristic of the antenna. FIG. 3 illustrates a plot of the power density on the boresight of an antenna that is 25 meters in diameter, illuminated uniformly at 95 GigaHertz (GHz), and having a fixed focus at 200 kilometers (km) as shown by reference numeral 17. This plot is compared in FIG. 3 to an ideal focus tracking range antenna (reference numeral 16) with the same characteristics except the focus is programmed to continuously track the range.

An equation for calculation of the boresight relative power density (P) based on a scalar potential theory is illustrated in FIG. 4. In FIG. 4, D=aperture diameter (e.g., 25 meters); zt=range in meters; rt, Φt=radius and angle off boresight at range zt and on boresight rt=0.0 and Φt=0.0; and F=focal length in meters. If F is set equal to the range, zt, then the focus tracks the range.

Figure 6:
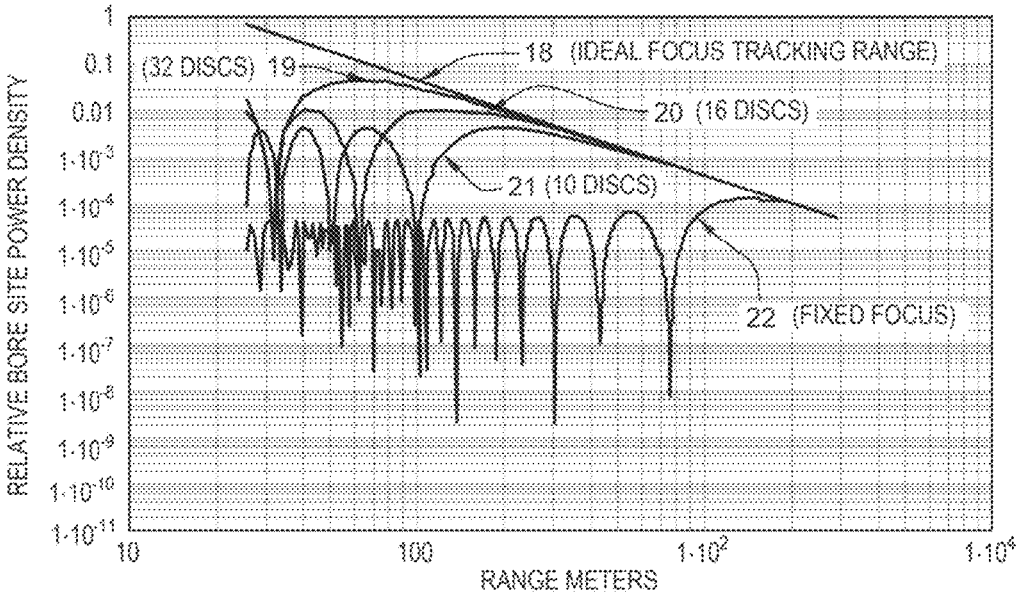
FIG. 6 shows traces plotted using the equation of FIG. 5 for a variety of disc apertures of an N section disc antenna focused at a range F.

The embodiments described herein provide an approximation to the range tracking characteristic. The range tracking characteristic is the power density displayed as a function of range, when the antenna is focused at that range. The antenna either being an ideal spherical shape of the approximated shape or a multiple disc shape (100 or 200) as described herein. The larger the number of N discs, then the closer the approximation will be. To illustrate the approximation, the boresight power density is calculated by the equation illustrated in FIG. 5. In FIG. 5, $Dr_n$ is calculated as follows:

$$Dr_n = \sqrt{\frac{D^2}{N} + (Dr_{n-1})^2}$$

then D=the outside diameter of the total antenna (i.e., the outside diameter of the outer disc 108 which is labeled D4 in FIGS. 1A and 1B) or aperture diameter (e.g., 25 meters); N=number of disc elements, including the central area or disc; n=the individual disc identification number; k=2π/λ is the wave number; and λ=wave length in meters. Using the equation of FIG. 5, the traces in FIG. 6 are calculated for a variety of disc apertures (e.g., 10 discs shown by reference numeral 21; 16 discs shown by reference numeral 21; and 32 discs shown by reference numeral 19) and compared to an aperture with a focus fixed at 50 kilometers (kin) (reference numeral 22) and an ideal focus tracking antenna (reference numeral 18). It is clear that the larger the number of discs, the more closely the antenna assembly 100 approximates to the ideal focus tracking antenna at a minimum range. By running calculations using many discs, an empirical normalized function relating the first null in the near field, as range is decreasing, to $D^2/\lambda$, is derived as:

$$Rfn(N) = -5.4 \cdot N^5 + 0.50717 \cdot N^4 - 0.001828 \cdot N^3 + 0.03152 \cdot N^2 - 0.264673 \cdot N + 1$$

where Rfn(N)=range of the first null in the near field encountered with decreasing range normalized to $D^2/\lambda$;

D=the outside diameter of the antenna; λ=the wave length; and N=number of equal area discs in the exemplary embodiments of this disclosure.

One of the practical advantages of the embodiments described herein relates to the fact that the discs are substantially flat and therefore much easier to fabricate than a contoured antenna surface. In addition, the exemplary embodiments provide for the adjustable focusing of a spherical disc antenna. Although the embodiments described herein consist of circular discs 102, 104, 106 and 108 of substantially equal area, the same basic principles include discs of unequal area, shapes other than discs, such squares, rectangles, ellipses, and any other shapes that are nested in a similar manner as the antenna assemblies 100 or 200.

The capability afforded by a variable focus antenna may enhance the performance systems such as Active Denial Technology by providing the capability to control an optimum spot size at a given range. The variable focus antenna may also be used for systems to transmit microwave power to remote targets that have variable ranges; such as Unmanned Aerial Vehicles (UAV's) and launching of satellites via microwave power to thrust conversion technology. Commercial applications include applications that would benefit from the advantage of having a variable focus antenna such as transmission of power to remote sites that have variable range locations including oil fields or seismic exploration. In radar embodiments, the reception capabilities of the antenna assemblies 100 and 200 would be advantageous.

The foregoing described embodiments have been presented for purposes of illustration and description and are not intended to be exhaustive or limiting in any sense. Alterations and modifications may be made to the embodiments disclosed herein without departing from the spirit and scope of the invention. No language in the specification should be construed as indicating any non-claimed element as essential to the practice of the invention. The actual scope of the invention is to be defined by the claims.

The definitions of the words or elements of the claims shall include not only the combination of elements which are literally set forth, but all equivalent structure, material or acts for performing substantially the same function in substantially the same way to obtain substantially the same result.

All references, including publications, patent applications, patents and website content cited herein are hereby incorporated by reference to the same extent as if each reference were individually and specifically indicated to be incorporated by reference and was set forth in its entirety herein.

The words used in this specification to describe the invention and its various embodiments are to be understood not only in the sense of their commonly defined meanings, but to include by special definition in this specification any structure, material or acts beyond the scope of the commonly defined meanings. Thus if an element can be understood in the context of this specification as including more than one meaning, then its use in a claim must be understood as being generic to all possible meanings supported by the specification and by the word itself.

Recitation of ranges of values herein are merely intended to serve as a shorthand method of referring individually to each separate value falling within the range, unless otherwise indicated herein, and each separate value is incorporated into the specification as if it were individually recited herein. Therefore, any given numerical range shall include whole and fractions of numbers within the range. For example, the range "1 to 10" shall be interpreted to specifically include whole numbers between 1 and 10 (e.g., 1, 2, 3, . . . 9) and non-whole numbers (e.g., 1.1, 1.2, . . . 1.9).

Neither the Title (set forth at the beginning of the first page of the present application) nor the Abstract (set forth at the end of the present application) is to be taken as limiting in any way as the scope of the disclosed invention(s). The title of the present application and headings of sections provided in the present application are for convenience only, and are not to be taken as limiting the disclosure in any way.

Although process (or method) steps may be described or claimed in a particular sequential order, such processes may be configured to work in different orders. In other words, any sequence or order of steps that may be explicitly described or claimed does not necessarily indicate a requirement that the steps be performed in that order unless specifically indicated. Further, some steps may be performed simultaneously despite being described or implied as occurring non-simultaneously (e.g., because one step is described after the other step) unless specifically indicated. Where a process is described in an embodiment the process may operate without any user intervention.

The invention claimed is:

1. An antenna comprising:
a circular and planar central plate;
a plurality of annular discs of differing radii, spaced apart from one another and from the central plate, and located, respectively, in planes substantially parallel to the central plate;
the central plate and discs having respective geometric centers;
a linear axis intersecting the centers;
the central plate and the discs lying normal to the axis; and
the discs being translatable along the axis, relative to the central plate and to each other, whereby
the antenna has an adjustable focal point.

2. The antenna of claim 1, wherein:
each disc has a circular opening therethrough; and
each opening being concentric with the disc.

3. The antenna of claim 2, wherein;
the central plate has a central plate diameter;
the discs include an innermost disc lying adjacent to the central plate; and
the opening for the innermost disc having an innermost disc opening diameter equal to the central plate diameter.

4. The antenna of claim 3, wherein the plurality of discs is comprised of at least three discs.

5. The antenna of claim 4, wherein:
each of the discs has a periphery and an outer diameter extending to the periphery; and
the outer diameters and the central plate diameter form a spherical contour.

6. The antenna of claim 5, wherein the spacing of the discs is a function of a modulo of a wavelength of an operating frequency of the antenna.

7. The antenna of claim 6, wherein:
a surface of each disc facing the central plate defines a disc area; and
the respective disc areas are equal.

8. The antenna of claim 7, wherein a surface of the central plate has a central plate area equal to the disc area.

9. The antenna of claim 8, further comprising a boresight lying collinear with the axis.

10. The antenna of claim 9, further comprising a plurality of actuators spaced around the discs for independently translating each of the discs along the axis.

11. The antenna of claim 10, wherein the antenna is constructed of materials including a material capable of reflecting microwaves.

12. The antenna of claim 3, wherein:

the plurality of discs is comprised of at least three discs;

the center of each disc lies at a distance from the central plate, measured along the axis;

the distance for each center increases for each successive disc, with the distance for the innermost disc having a least value;

the opening for each disc has an opening diameter;

each of the discs has a periphery and an outer diameter extending to the periphery; and each successive disc has an outer diameter equal to the opening diameter of an adjacent disc lying at a greater distance from the central plate.

13. The antenna of claim 12, wherein the spacing of the discs is a function of a modulo of a wavelength of an operating frequency of the antenna.

14. The antenna of claim 13, wherein the outer diameters and the central plate diameter form a spherical contour.

15. The antenna of claim 12, wherein:

a surface of each disc defines a disc area; and the respective disc areas are equal.

16. The antenna of claim 15, wherein a surface of the central plate has a central plate area equal to the disc area.

17. The antenna of claim 16, wherein the outer diameters and the central plate diameter form a spherical contour.

18. The antenna of claim 17, further comprising a plurality of actuators spaced around the discs for independently translating each of the discs along the axis.

19. The antenna of claim 17, wherein the antenna is comprised of a material capable of reflecting microwave radiation.

20. The antenna of claim 17, further comprising a boresight lying collinear with the axis.

* * * * *